US012599183B2

(12) United States Patent
Trangmar et al.

(10) Patent No.: US 12,599,183 B2
(45) Date of Patent: Apr. 14, 2026

(54) FORMED BRASSIERE AND ASSOCIATED METHOD OF MANUFACTURE

(71) Applicant: VEIL INTIMATES LLC, Denver, CO (US)

(72) Inventors: Nancy Trangmar, Denver, CO (US); Meghan Marsden, Denver, CO (US)

(73) Assignee: VEIL INTIMATES LLC, Denver, CO (US)

( * ) Notice: Subject to any disclaimer, the term of this patent is extended or adjusted under 35 U.S.C. 154(b) by 203 days.

(21) Appl. No.: 18/371,023

(22) Filed: Sep. 21, 2023

(65) Prior Publication Data

US 2024/0008562 A1 Jan. 11, 2024

Related U.S. Application Data

(60) Continuation of application No. 16/783,871, filed on Feb. 6, 2020, now Pat. No. 11,800,901, which is a division of application No. 15/344,666, filed on Nov. 7, 2016, now Pat. No. 10,588,359.

(60) Provisional application No. 62/251,187, filed on Nov. 5, 2015.

(51) Int. Cl.

| | |
|---|---|
| ***A41C 5/00*** | (2006.01) |
| ***A41C 3/00*** | (2006.01) |
| ***A41C 3/10*** | (2006.01) |
| ***A41C 3/14*** | (2006.01) |

(52) U.S. Cl.

CPC ..... *A41C 5/005* (2013.01); *A41C 3/0014* (2013.01); *A41C 3/10* (2013.01); *A41C 3/142* (2013.01)

(58) Field of Classification Search

CPC .. A41C 3/14; A41C 3/142; A41C 3/10; A41C 5/005

USPC ..... 450/39

See application file for complete search history.

(56) References Cited

U.S. PATENT DOCUMENTS

| | | | | | |
|---|---|---|---|---|---|
| 2,854,984 | A * | 10/1958 | Rosenthal | A41C 3/06 | D2/706 |
| 3,021,844 | A * | 2/1962 | Flagg | A41C 3/10 | 450/39 |
| 3,021,845 | A * | 2/1962 | Smith | A41C 3/10 | 450/39 |
| 3,062,216 | A * | 11/1962 | Stein | A41C 3/10 | 450/43 |
| 3,064,329 | A * | 11/1962 | Westberg | A41C 5/005 | 156/196 |
| 3,119,393 | A * | 1/1964 | Bernfeld | A41C 3/00 | D2/708 |
| 3,163,167 | A * | 12/1964 | Chisholm | A41C 3/142 | D2/706 |

(Continued)

FOREIGN PATENT DOCUMENTS

WO 2016022729 A1 2/2016

*Primary Examiner* — Gloria M Hale

(74) *Attorney, Agent, or Firm* — Greenberg Traurig, LLP

(57) ABSTRACT

A brassiere and associated method of manufacture is presented. A graticulate support member is producible by additive printing. The graticulate support member may be positioned between each of a first cup cover and a second cup cover of the brassiere. The graticulate support member may include a thickness gradient devised to maintain rigidity of the formed cup from a maximum thickness medially centered at a first edge of the graticulate support member towards a minimum thickness realized at the extremity of a second edge.

20 Claims, 6 Drawing Sheets

(56) References Cited

U.S. PATENT DOCUMENTS

| | | | | |
|---|---|---|---|---|
| 3,187,754 | A * | 6/1965 | King | A41C 3/00 450/40 |
| 3,446,213 | A * | 5/1969 | Goldman | A41C 3/10 450/39 |
| 6,257,951 | B1 * | 7/2001 | DeMarco | A41C 3/10 450/55 |
| 8,840,442 | B2 * | 9/2014 | Linkon | A41C 3/10 450/36 |
| 10,993,483 | B2 * | 5/2021 | Trangmar | A41C 3/142 |
| 11,793,246 | B2 * | 10/2023 | Trangmar | A61B 5/6804 |
| 11,800,901 | B2 * | 10/2023 | Trangmar | A41C 3/0014 |
| 2002/0106970 | A1 * | 8/2002 | Falla | A41B 17/00 450/1 |
| 2003/0162479 | A1 * | 8/2003 | Tonsor | A41C 3/14 450/54 |
| 2013/0065485 | A1 * | 3/2013 | Goodwin | A41C 3/10 450/41 |
| 2015/0087203 | A1 * | 3/2015 | Turlan-Van Der Hoeven | A41C 3/10 450/93 |
| 2015/0118936 | A1 * | 4/2015 | Schlueter | A41C 3/02 450/1 |
| 2015/0118937 | A1 * | 4/2015 | Wan | A41C 3/0085 450/92 |

* cited by examiner

FORMED BRASSIERE AND ASSOCIATED METHOD OF MANUFACTURE

CROSS-REFERENCE TO RELATED APPLICATIONS

This application is a continuation of U.S. patent application Ser. No. 16/783,871, filed Feb. 6, 2020, which is a divisional of U.S. patent application Ser. No. 15/344,666, filed Nov. 7, 2016, now issued U.S. Pat. No. 10,588,359, issued Mar. 17, 2020, which claims the benefit of U.S. Provisional Patent App. No. 62/251,187 filed on Nov. 5, 2015, entitled "FORMED BRASSIERE AND ASSOCIATED METHOD OF MANUFACTURE", each of which is incorporated herein by reference in its entirety.

BACKGROUND

Various types of brassieres are seen in the prior art. Nearly all make use of an underwire, disposed in a channel wrought along an underside of a cup, to create tensile rigidity and support the wearer's breasts in contact proximal the infra-mammary fold. This underwire is typically uncomfortable, drawn taught against the user's body, and points of wear exist whereby the underwire emerges from the channel at either end effectively shortening the lifespan of the brassiere.

What is needed is a formed brassiere and associated method of manufacture whereby cups of a brassiere are formable without the need of an underwire or underwire channel and support and uplift of the wearer's breast is nonetheless maintained effective.

Additionally, advances in additive printing make printing on demand a cost-effective strategy and particular cups, sized and formed to accommodate unique anatomy of any particular wearer, are contemplated producible by employment of the present method.

FIELD OF THE INVENTION

The present invention relates to a formed brassiere and associated method of manufacture, and more particularly, to a formed brassiere and associated method of manufacture that includes a graticulate support member disposed in between each of a first cup cover and a second cup cover, whereby a cup is formable by forcing and heating to fuse a cup together and effect volumetric doming of the cup particular to accommodate the anatomy of a user.

Customized production of cups for particular users is likewise contemplated as part of this invention whereby a scan or other image capture of a user's anatomy may render a digital image translatable to provide three dimensional imaging and production parameters of a particularly sized graticulate support member positional between sized cup covers for volumetric doming by application of force and heat to a particular capacity determined conformable to the particular user.

While the method herein contemplated for manufacture renders printing of a planar graticulate support member, to be volumetrically domed during formation of a cup in conjunction with the first and second cup covers when heat and force is there applied, it should be noted by anyone of ordinary skill in the art that printing the graticulate support member into particular domed, volumetric, or warped planes is also contemplated as part of this invention, the general components required to form the formed brassiere capable of forging with pre-domed or volumetric parts nonetheless.

SUMMARY OF THE INVENTION

The general purpose of the formed brassiere and associated method of manufacture, described subsequently in greater detail, is to provide a formed brassiere and associated method of manufacture which has many novel features that result in a formed brassiere and associated method of manufacture which is not anticipated, rendered obvious, suggested, or even implied by prior art, either alone or in combination thereof.

The present formed brassiere and associated method of manufacture has been devised to enable a garment capable of supporting and uplifting the breasts of a user without the need of an underwire or associated channel in which such an underwire is caused to reside. The present formed brassiere and associated method of manufacture further enables customized cups conformed to the particular anatomy of unique users, and may enable customized garments formable upon demand In an example embodiment herein presented, the instant formed brassiere and associated method of manufacture, therefore, includes a polymeric, additive printed, graticulate support member having an arcuate first edge and an arcuate second edge. The first edge diverges from the second edge at a proximal apex, bounds a field of a graticulate matrix along one side, and converges with the second edge at a distal apex. The graticulate matrix, thus bounded by the first and second edges, comprises an angled arrangement of interlacing members.

The graticulate support member includes a maximum thickness disposed medially upon the first edge, and a minimum thickness, disposed at the second edge, whereby a thickness gradient is disposed from the maximum thickness at the first edge toward each of the proximal and distal apexes and the minimum thickness at the second edge. The graticulate matrix, therefore includes a gradient of rigidity disposed in proportion to the thickness gradient previously described.

The graticulate support member is embedded between a first cup cover and a second cup cover whereby a cup is formable. Application of heat and force to stretch and effect doming of the graticulate support member, thereby to forge said graticulate support member and each first and second cup cover into a single volumetric cup, is subsequently effective.

Customized volumetric cups are contemplated as part of this invention, the parameters of said cups translatable from a captured image of a user's anatomy. Specific sized graticulate support members are thereby producible, and embeddable with specific sized first and second cup covers, whereby doming to form specific volumetric cups is enabled.

Image capture of a particular user enables generation of a digital profile of the user. Additive printing is thereby applicable to produce graticulate support members sized appropriately to meet an individual's anatomical variations. This is particular useful for users having anatomical variances or irregularities as may result from postoperative surgeries, such as, for example, lumpectomies, mastectomies, augmentation, or other reconstructive, augmentative, or reductive surgeries. It is further contemplated that at least a portion of a mandrel and a mold, used in forming the cups, is likewise producible upon demand whereby specific shaping of customized graticulate support members is effective. Thus particular shaped cups are creatable formed to the anatomy of any particular user and producible upon demand.

Thus has been broadly outlined the more important features of the present formed brassiere and associated method of manufacture so that the detailed description thereof that follows may be better understood and in order that the present contribution to the art may be better appreciated.

For better understanding of the formed brassiere and associated method of manufacture, its operating advantages and specific objects attained by its uses, refer to the accompanying drawings and description.

DETAILED DESCRIPTION OF THE DRAWINGS

Figure 1:
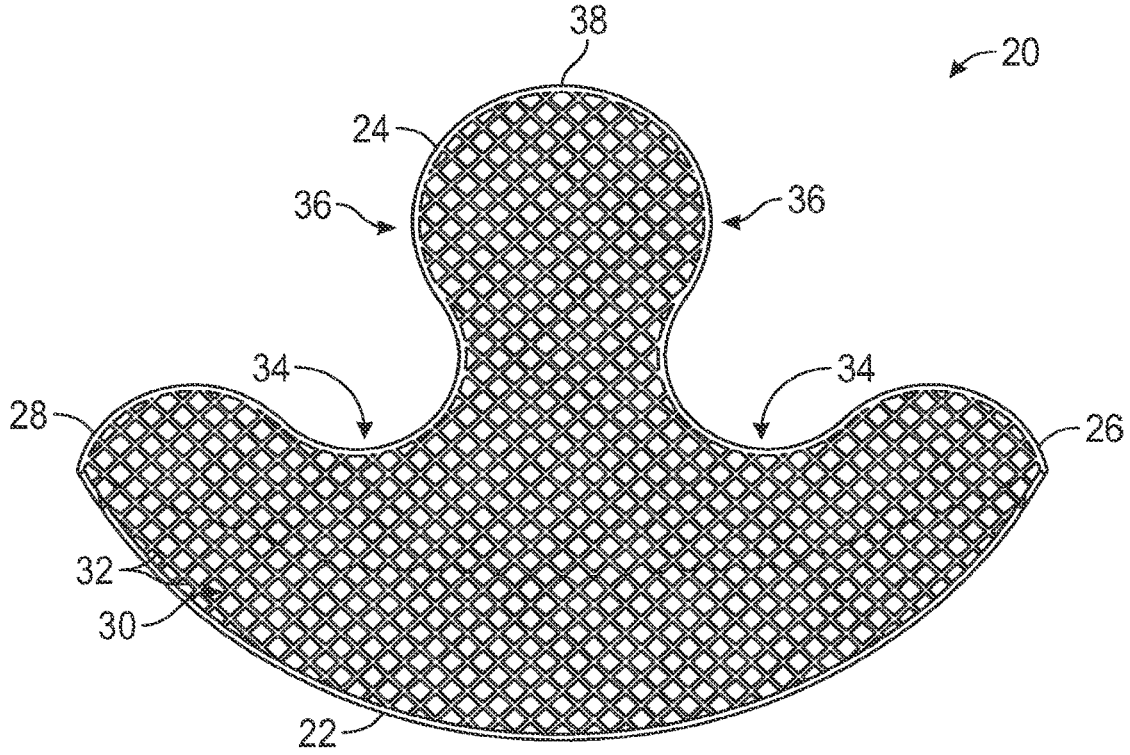
FIG. 1 is a top view of an example embodiment of a graticulate support member.

With reference now to the drawings, and in particular FIGS. 1 through 9 thereof, example of the instant formed brassiere and associated method of manufacture employing the principles and concepts of the present formed brassiere and associated method of manufacture and generally designated by the reference number 10 will be described.

Referring to FIGS. 1 through 9 a preferred embodiment of the formed brassiere and associated method of manufacture 10 is illustrated.

The present formed brassiere and associated method of manufacture contemplates an undergarment for women wearable to support the breasts without the need of an underwire or underwire channel. Further, the present formed brassiere and associated method of manufacture enables custom formed cups conformable to the breasts of any particular woman, including women who have undergone breast augmentation, lumpectomy, mastectomy, reconstructive surgery, or any operation rendered to the breast capable of altering breast volume, including natural alterations resulting, for example, from pregnancy and breast feeding.

The present formed brassiere 10 includes a generally planar, graticulate support member 20 disposed between a first cup cover 50 and a second cup cover 52. The graticulate support member 20 includes a first edge 22 and a second edge 24. A graticulate matrix 30 is disposed between the first edge 22 and the second edge 24. The graticulate support member 20 further includes a maximum thickness 40 realized medially at the first edge 22 and a minimum thickness 42 realized at the second edge 24. Thus the graticulate support member 20 includes a graded cross-section across the graticulate matrix 30, tapering from the maximum thickness 40 toward the minimum thickness 42.

The graticulate support member 20 is disposed between the first cup cover 50 and the second cup cover 52. The first edge 22 of the graticulate support member 20 provides support for the wearer underlying the breast proximal the inframammary fold, and obviates the need of an underwire or the associated channel that houses the underwire presently seen in the state of the art. The graticulate matrix 30 is formed to shape appropriately to conform to the anatomy of a particular wearer, and the second edge 24, having the minimum thickness 42, tapers inside the formed cup 100 proximal the pectoralis of the wearer. Thus the graticulate support member 20, disposed centrally in the cup 100, defines the shape of the cup 100 and provides the necessary support for the wearer using the present invention 10.

Methods of manufacture of the present formed brassiere 10 contemplated herein include additive printing of the graticulate support member 20, wherein the support member 20 is printable, polymeric, and shapeable between boundaries described by the first and second edges 22, 24. The graticulate support member 20 may be printed to conform to the anatomy of a particular user, and adapted to an individual wearer by image capture of the particular user whereby the graticulate support member 20 is printable to fit a particular person.

The graticulate support member 20 may be printed as a planar substrate, having the maximum and minimum thicknesses 40, 42 as volumetric dimension only, and then fit between the first and second cup covers 50, 52, there heated and fused into said first and second cup covers 50, 52 to form a cup 100, whereby application of heat below the melting point of the graticulate support member 20 renders the cup 100 formable to a desired cup shape. Doming of the cup 100 is thereby practicable at time of cup formation when the graticulate support member 20 is inserted in between each of the first and second cup covers 50, 52 and heat is applied to form the cup shape desired.

The first cup cover 50 is contemplated to be a soft foam disposed to contact the breast of a wearer when the instant formed brassiere 10 is worn. The second cup cover 52 is disposed to overlie the graticulate support member 20 and remain exteriorly positioned overlying the breast of a wearer. Thus, for the purposes of discussion herein, while both the first cup cover 50 and the second cup cover 52 have a like doming and volumetric form (small variances in size by virtue of position relative the graticulate support member 20 notwithstanding) the first cup cover 50 is formed as a concavity, to accommodate and contact the breast of a wearer, and the second cup cover 52 is formed as a convexity, to exteriorly overlie and cover the breast of a wearer.

Figure 2:
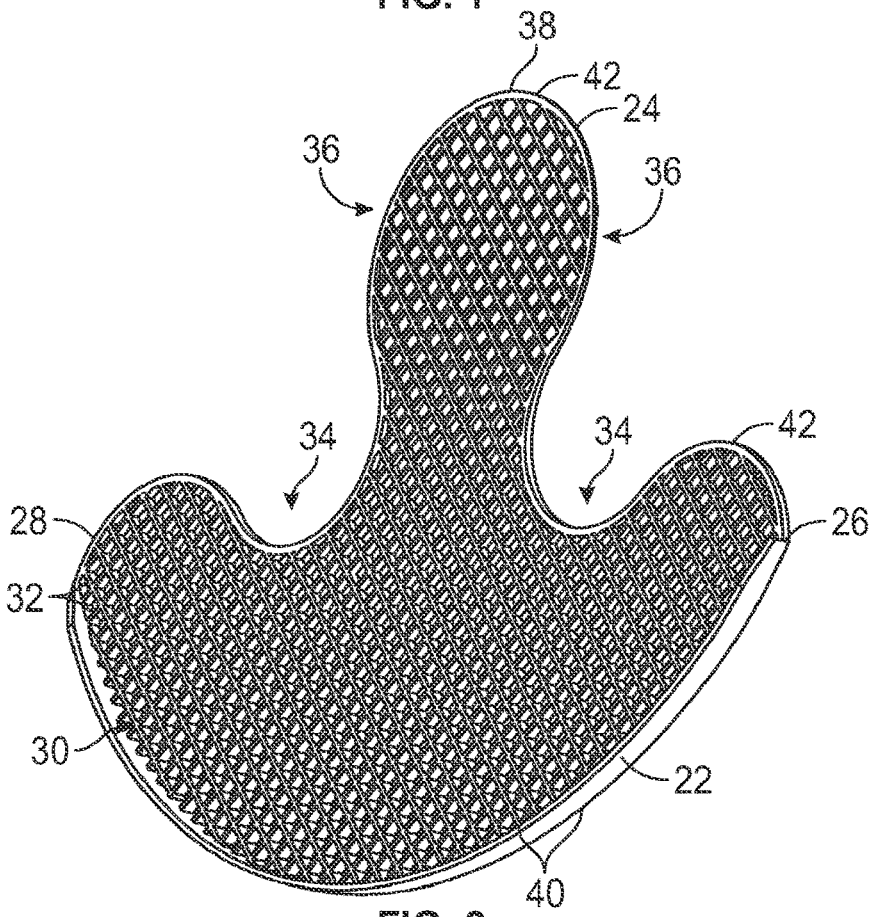
FIG. 2 is an isometric view of an example embodiment of a graticulate support member.

Discussing now an example embodiment of the graticulate support member 20 illustrated in the accompanying FIGS. 1 and 2: graticulate support member 20 includes an arcuate first edge 22 and an opposite arcuate second edge 24. Each of the arcuate first and second edges 22, 24 diverge from a proximal apex 26, span the delimit of the graticulate matrix 30, and converge at a distal apex 28. The graticulate matrix 30 is disposed between the first and second edges 22, 24 in angled arrangement of interlacing members 32.

In the example embodiment illustrated herein, the gradient of the second edge 24 is positive from the proximal apex 26, then turns negative into an inversion pocket 34, before turning positive again to rise through an S-shaped portion 36, to culminate at an apical arc 38 at a distance farthest from the first edge 22. The second edge 22 maintains symmetry reflected through a medial axis of the graticulate support member 20, and defines a like perimeter between the apical arc 38 and the distal apex 28.

As shown in FIG. 2, a maximum thickness 40 is realized medially at the first edge 22 and a minimum thickness 42 is realized at the second edge 24. The cross-section of the graticulate support member 20 therefore tapers from the maximum thickness 40 to the minimum thickness 42, from the first edge 22 toward the second edge 24 and toward each of the proximal and distal apexes 26, 28, whereby a decrease in rigidity is realized incrementally between the maximum thickness 40 and the minimum thickness 42 (see, for example, FIGS. 5, 6 and 7). The first edge 22 is thus maximally rigid at a medial point, relative the second edge 24, which second edge 24 is minimally rigid. Deformation of the graticulate support member 20 is thus effective by forcing and applying controlled heat thereto, said force distributed through the graticulate matrix 30 between the maximum thickness 40 and the minimum thickness 42 whereby a forcing gradient is enabled.

Figure 5:
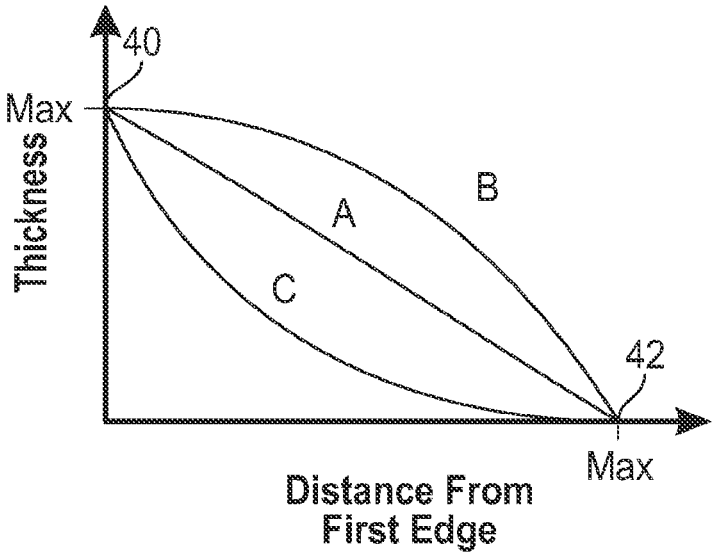
FIG. 5 is a graphical representation of example gradients of thickness from a first edge of the graticulate support member to a second edge of the graticulate support member.
Figure 6:
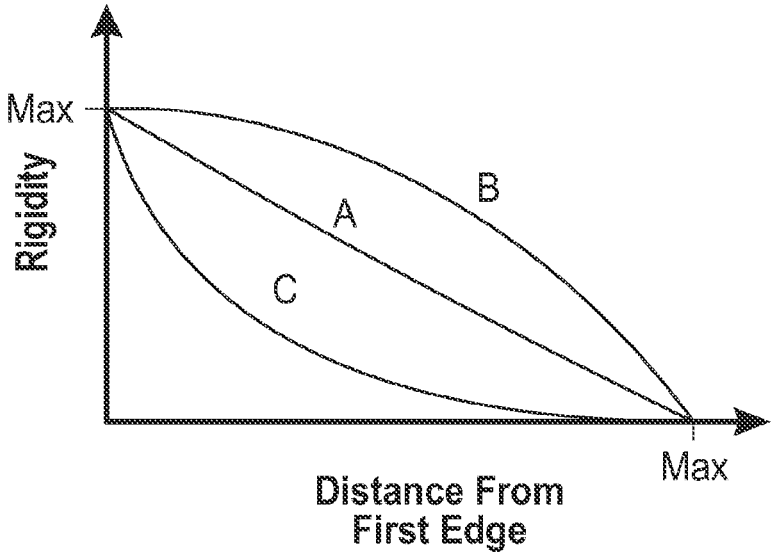
FIG. 6 is a graphical representation of example gradients of rigidity from a first edge of the graticulate support member to a second edge of the graticulate support member.

FIGS. 5 and 6 illustrate graphical representations of example embodiments associated thickness profiles (FIG. 5) and corresponding rigidity profiles (FIG. 6). Maximum thickness 40 tapers along a gradient (A, B, or C, as examples of thickness curves) in proportion to distance from a medial point disposed upon the first edge 22 (FIG. 5). Likewise (FIG. 6), rigidity tapers along a gradient (A, B, or C, as examples of a rigidity curve) in proportion to distance from the medial point disposed upon the first edge 22.

Figure 7:
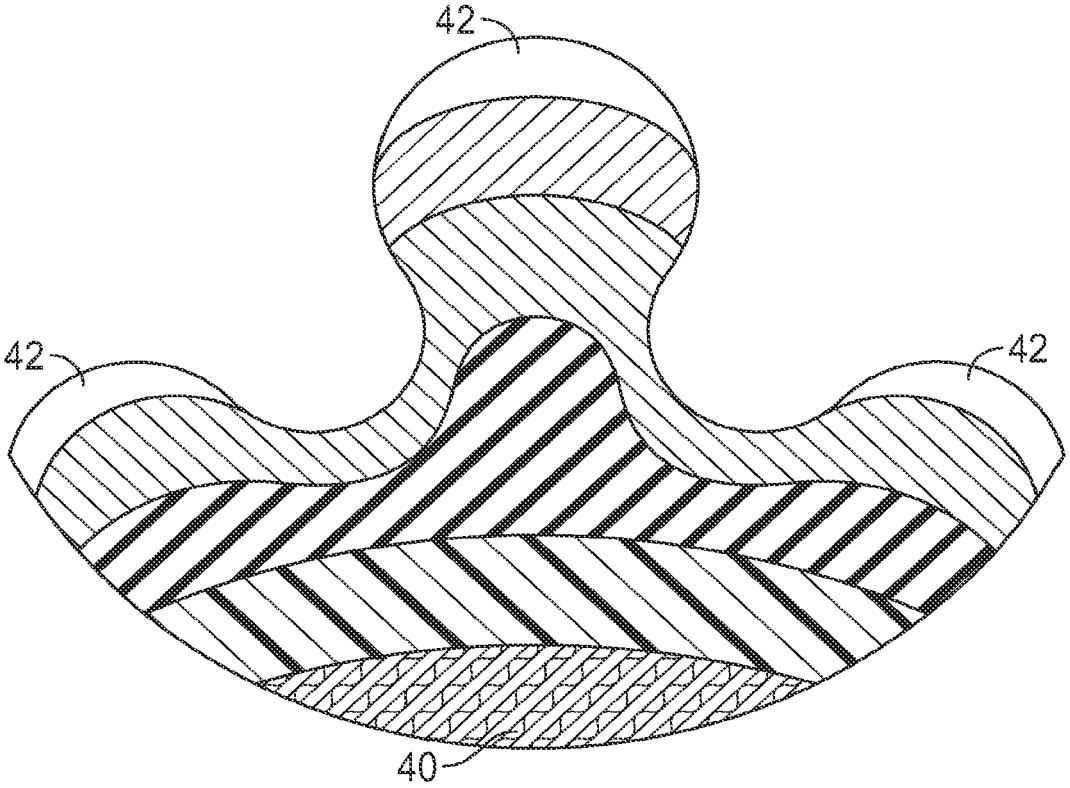
FIG. 7 is a graphical representation of example thickness of a graticulate matrix disposed between each of the first and second edges and each of a proximal and distal apex.
Figure 8:
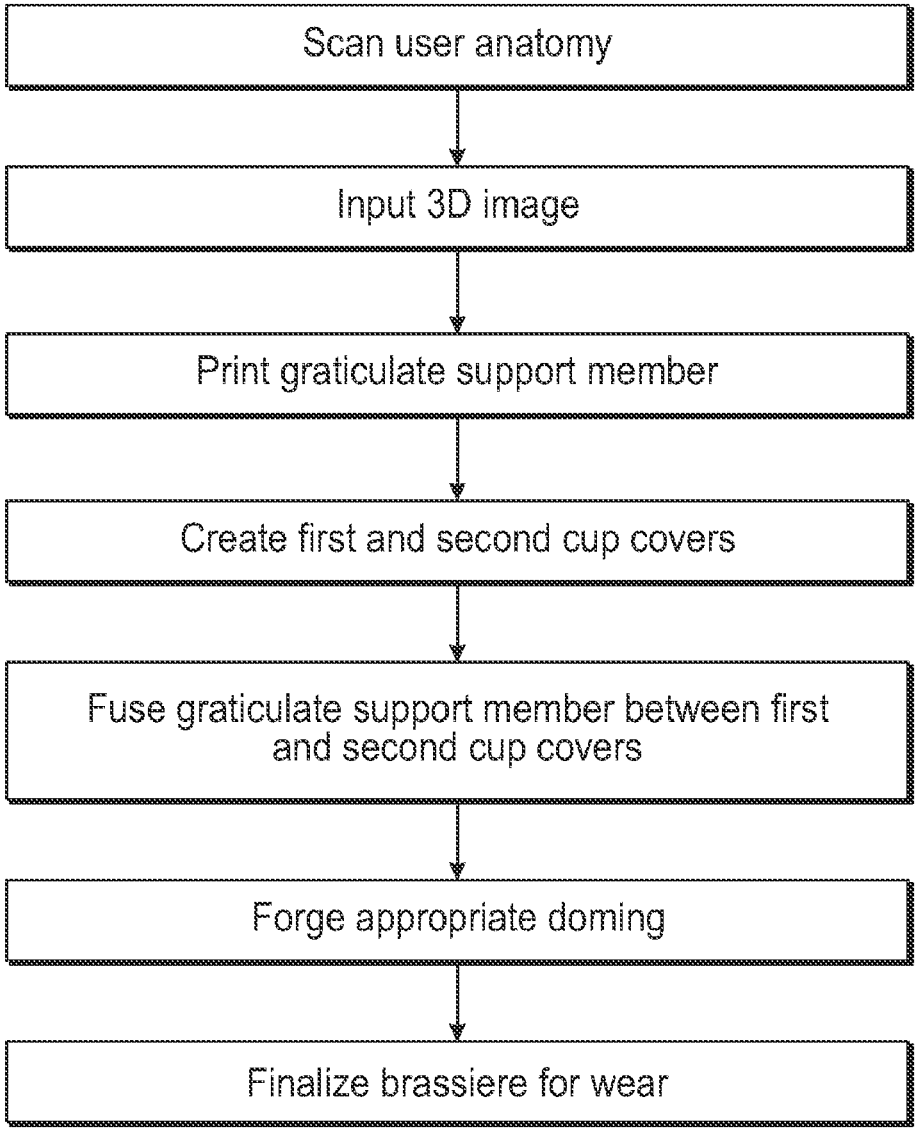
FIG. 8 is a flow diagram of an example method of manufacture of formed cups to create a customized formed brassiere for wear by a particular user with unique anatomy.
Figure 9:
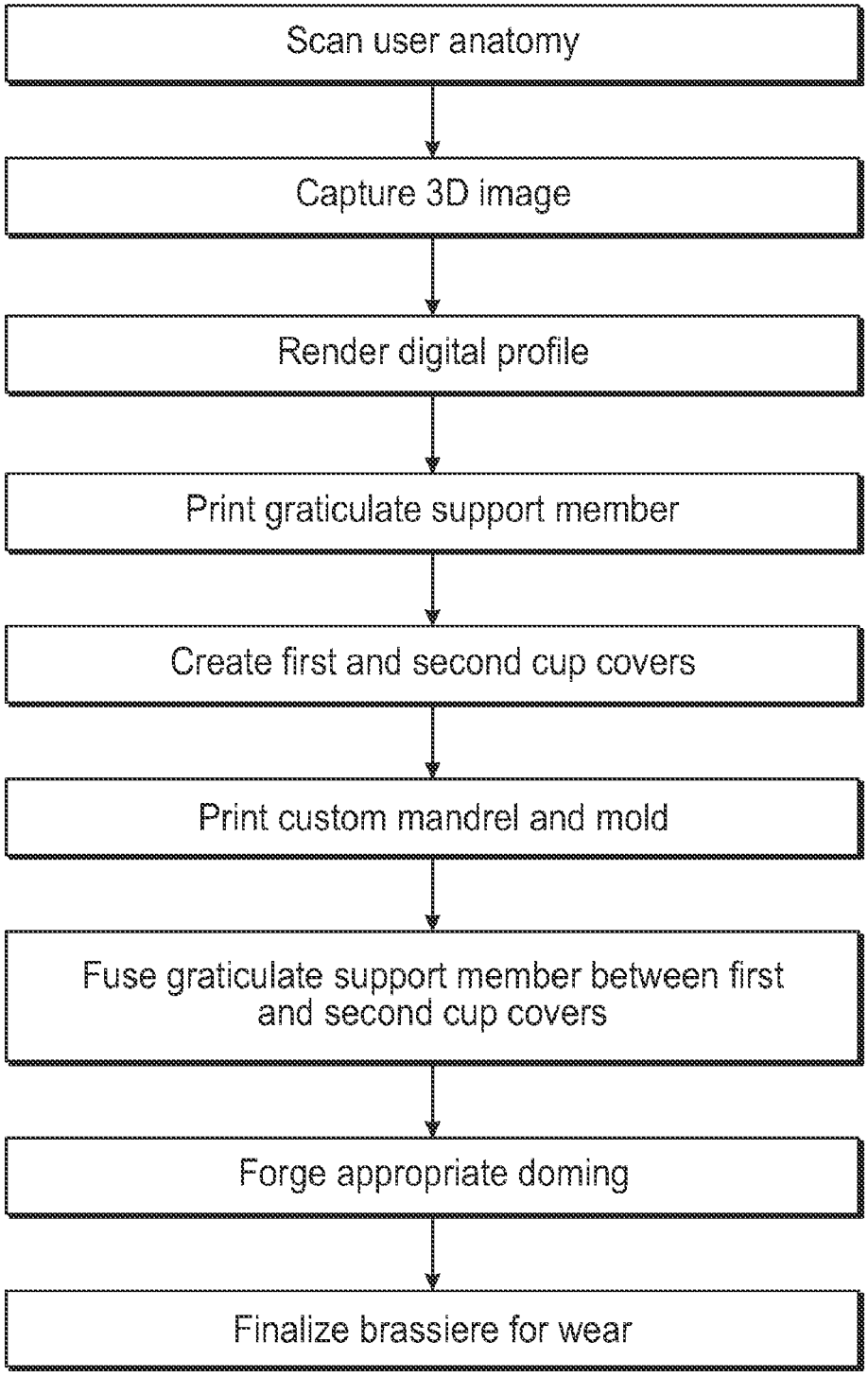
FIG. 9 is a flow diagram of an example method of manufacture of formed cups to create a customized formed brassiere for wear by a particular user with unique anatomy.

FIG. 7 illustrates a graphical map representation of this thickness gradient disposed from the maximum thickness 40 medially disposed at the first edge 22, towards each of the proximal and distal apexes 26, 28 in addition to the second edge 24. Example lines of like thickness are shown proportional to distance from a medial point upon the first edge 22.

Figure 3:
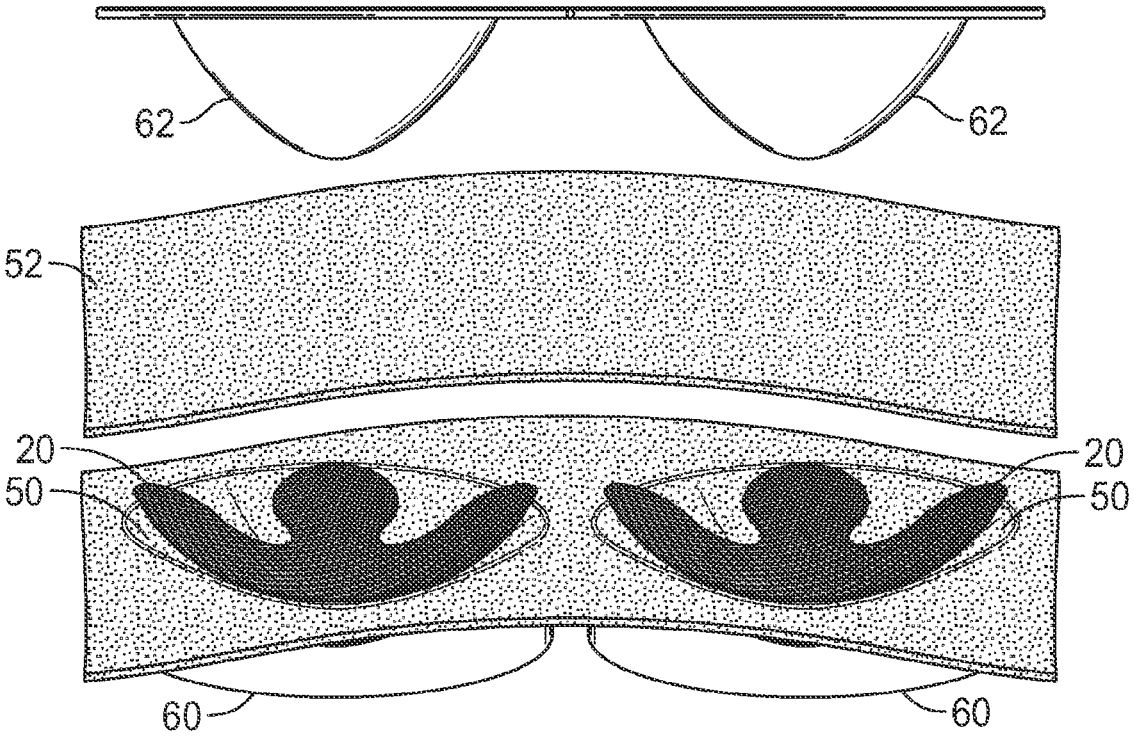
FIG. 3 is an elevation view of an example embodiment of a formed brassiere about to be pressed showing the graticulate support member disposed atop a first cup cover.

As shown in FIG. 3, first cup cover 50 is disposed to underlie the graticulate support member 20 and second cup cover 52 is disposed to overlie the graticulate support member 20. Once positioned appropriately, a cup 100 is formable by application of heat and force to mold the cup 100 to the desired shape and fuse the graticulate support member 20 and first and second cup members 50, 52 into a single cup 100. Thus cups 100 are formable to a desired shape, and a formed brassiere 10 is thereby manufacturable for wear.

Figure 4A:
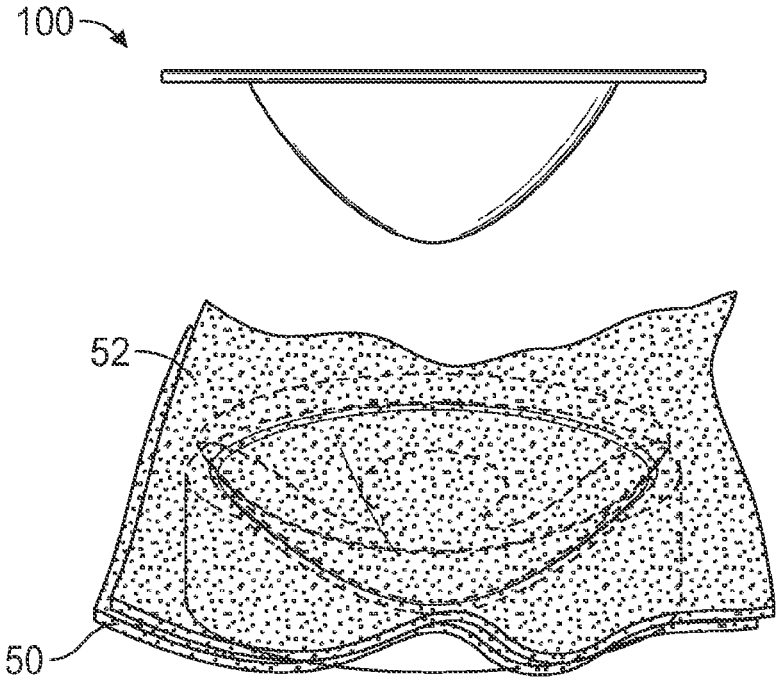
FIG. 4A is an elevation view of a a cup formed domically whereby the graticulate support member interior to each of said pair of cups maintains shape of said cups and each of the associated first and second cup covers are cohesive thereby.
Figure 4B:
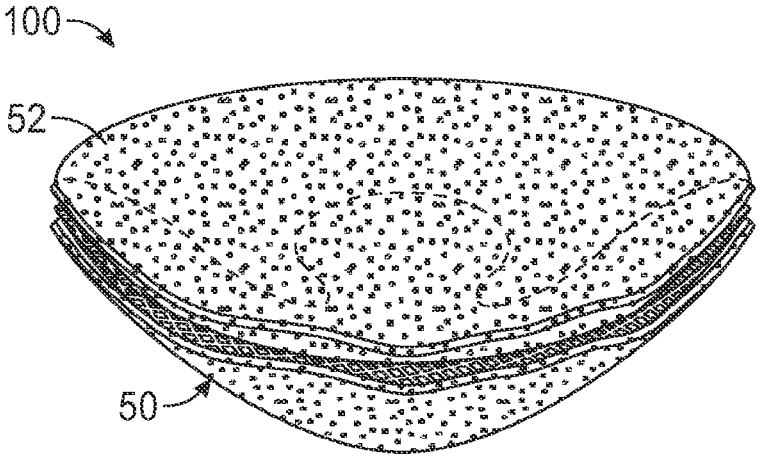
FIG. 4B is an elevation view of a cup formed domically with the graticulate support member therein.

As shown in FIG. 3 and FIGS. 4A and 4B, a mandrel 62 is applicable to force doming of the cups 100 by action of force and heat applied below the melting point of the graticulate support member 20. Mandrel 62 applies force to effect doming of the graticulate support member into mold 60 whereby domic shaping of the cups is enabled. The graticulate support member 20 thus fuses the first and second cup covers 50, 52, together, and maintains the specific shape effected by forcing of the mandrel 62 into the mold 60 at temperature.

Formation of particular cups 100 devised for wear by a particular user, and shaped, therefore, to accommodate a unique anatomy is contemplated by image capture of said particular user's anatomy. Image capture of the particular user's anatomy enables three-dimensional modeling of the user's anatomy as a digital profile, whereby additive printing of customized graticulate support members 20 and also, in some embodiments, at least portions of the mandrels 62, is enabled. Appropriately sized graticulate support members 20 are thereby printable by additive printing from suitable polymer, and appropriate first and second cup covers 50, 52 may likewise by stamped from foam blanks, for example. Cups 100 are then formable to dome volumetrically and fuse the graticulate support member 20 interior the cup 100, between the first and second cup covers 50, 52. Cups 100 are fittable to straps and blanks and a formed brassiere 10 is thus creatable for a particular user upon demand.

At least a portion of the mandrel 62, such as an outer covering, for example, may likewise by producible on demand in representation of a particular user's anatomy, particularly, for example, to accommodate irregular shaped breasts as may result from post-operative procedures, such as lumpectomies and partial mastectomies. In like manner, at least a portion of the mold 60, such as an outer covering, for example, may also be producible on demand in representation of a particular user's anatomy.

What is claimed is:

1. A brassiere comprising:

a pair of cups each having:

a first cup cover and a second cup cover;

a graticulate support member disposed between the first cup cover and the second cup cover;

wherein the graticulate support member comprises an integrated arrangement of angled interlacing members disposed between a first edge and a second edge; and wherein the graticulate support member maintains a domical shape of the cup effective to maintain support of a breasts of a wearer without the need of an underwire.

2. The brassiere of claim 1, wherein the first edge bounds a lowermost extremity of the graticulate support member; wherein a second edge bounds an uppermost extremity of the graticulate support member, the second edge diverging from a juncture with the first edge at a proximal apex, the second edge converging to the juncture with the first edge at a distal apex.

3. The brassiere of claim 2, wherein the graticulate support member has a maximum thickness disposed medially at the first edge and a minimum thickness disposed at the uppermost extremity of the second edge whereby the graticulate support member tapers in thickness medially from the first edge toward the second edge and toward each of the proximal and distal apexes.

4. The brassiere of claim 3, wherein the graticulate support member includes an angled arrangement of interlacing members, said interlacing members disposed diagonally between each of the first and second edges, said interlacing members disposed perpendicularly relative each other.

5. The brassiere of claim 4, wherein the second edge includes a positive gradient divergent from the proximal apex, said second edge curving to a negative gradient into an inversion pocket, said second edge turning to a positive gradient into an S-shaped portion, said S-shaped portion culminating at an apical arc, said second edge continuing to the distal apex in a mirror image from the apical arc reflected across a line of symmetry perpendicularly extended through the apical arc.

6. The brassiere of claim 5, wherein the graticulate support member is printable by additive printing and producible in dimensions adapted to an anatomy of a particular wearer.

7. The brassiere of claim 6, wherein a mandrel is pressed into a mold forming each cup.

8. The brassiere of claim 7, wherein the mandrel includes at least a portion producible customized to a dimensions determined from the anatomy of the particular wearer.

9. A brassiere comprising:

a pair of cups, each cup having:

a graticulate support member disposed between a first cup cover and a second cup cover, the graticulate support member comprising:

a first edge bounding a lowermost extremity of the graticulate support member;

a second edge bounding an uppermost extremity of the graticulate support member, said second edge diverging from a juncture with the first edge at a proximal apex, said second edge converging to the juncture with the first edge at a distal apex;

a maximum thickness disposed medially at the first edge;

a minimum thickness disposed at the second edge including portions of the proximal and distal apex demarked by said second edge; and a graticulate matrix disposed between the first and second edges having an integrated arrangement of angled interlacing members disposed between each of the first and second edges;

wherein the graticulate support member maintains a domical shape of the cup to maintain support of a breasts of a wearer without the need of an underwire.

10. The brassiere of claim 9, wherein the graticulate support member is printable by additive printing and producible in dimensions adapted to an anatomy of a particular wearer.

11. The brassiere of claim 10, wherein a mandrel is pressed into a mold forming cup.

12. The brassiere of claim 11, wherein the mandrel includes at least a portion producible customized to a dimensions determined from the anatomy of a particular wearer.

13. The brassiere of claim 12, wherein the mold includes at least a portion producible customized to the dimensions determined from the anatomy of the particular wearer.

14. The brassiere of claim 9, wherein the second edge includes a positive gradient divergent from the proximal apex, said second edge curving to a negative gradient into an inversion pocket, said second edge turning to a positive gradient into an S-shaped portion, said S-shaped portion culminating at an apical arc, said second edge continuing to the distal apex in a mirror image from the apical arc reflected across a line of symmetry perpendicularly extended through the apical arc.

15. The brassiere of claim 9, wherein the rigidity of the graticulate support member is proportional to the thickness of the graticulate support member.

16. The brassiere of claim 9, wherein the interlacing members are disposed diagonally between each of the first and second edges, and wherein the interlacing members are disposed perpendicularly relative each other.

17. The brassiere of claim 9, wherein each of the pair of cups are coupled to a strap.

18. The brassiere of claim 6, wherein the first edge is configured to be positioned proximal an inframammary fold of the particular wearer.

19. The brassiere of claim 1, wherein each of the pair of cups are coupled to a strap.

20. The brassiere of claim 3, wherein the rigidity of the graticulate support member is proportional to the thickness of the graticulate support member.

* * * * *